US006843393B2

(12) United States Patent
Sinclair

(10) Patent No.: US 6,843,393 B2
(45) Date of Patent: Jan. 18, 2005

(54) ADJUSTABLE LEATHER RIFLE SLING

(76) Inventor: Patrick G. Sinclair, 13 Mdv Rd., Nashua, MT (US) 59248

( * ) Notice: Subject to any disclaimer, the term of this patent is extended or adjusted under 35 U.S.C. 154(b) by 48 days.

(21) Appl. No.: 10/455,621

(22) Filed: Jun. 6, 2003

(65) Prior Publication Data

US 2004/0245297 A1 Dec. 9, 2004

(51) Int. Cl.[7] ..... F41C 23/02
(52) U.S. Cl. ..... 224/150; 224/913
(58) Field of Search ..... 224/150, 913; 24/2.5; 42/85

(56) References Cited

U.S. PATENT DOCUMENTS 1,323,701 A * 12/1919 Lethern ..... 224/150
2,059,949 A * 11/1936 Imler ..... 224/150
2,480,129 A * 8/1949 Gebler ..... 224/150
3,334,794 A * 8/1967 Saari et al. ..... 224/150
3,495,770 A * 2/1970 Rolling et al. ..... 224/150
4,361,258 A * 11/1982 Clark ..... 224/150
4,401,246 A * 8/1983 Dickinson et al. ..... 224/150
4,817,835 A 4/1989 Tarr, Jr.
5,282,558 A * 2/1994 Martinez ..... 224/150
5,433,360 A 7/1995 Rock
5,802,756 A 9/1998 Hightower
2003/0041498 A1 3/2003 Mazzagetti

* cited by examiner

*Primary Examiner*—Stephen K. Cronin
(74) *Attorney, Agent, or Firm*—Richard C. Litman

(57) ABSTRACT

The adjustable leather rifle sling is a shoulder sling for carrying a rifle, shotgun, or other long gun. The adjustable leather rifle sling is formed from a single leather strap. A large adjustable loop is formed in one end of the leather strap, and secured by a slide-lock knot. The slide-lock knot is formed by cutting two slits into the leather strap, to form three small strips. Each of the small strips is turned 90° so that three small bands are formed perpendicular to the length of the leather sling. The adjustable loop is made by passing an end of the leather strap through the bands of the slide-lock knot. Thus, an adjustable loop is formed in the adjustable leather rifle sling without the need for clasps, slides, buckles or other fittings.

5 Claims, 9 Drawing Sheets

ADJUSTABLE LEATHER RIFLE SLING

BACKGROUND OF THE INVENTION

1. Field of the Invention

The present invention relates to a gun sling for carrying a rifle, shotgun, or similar long gun. More specifically, the invention is an adjustable leather rifle sling.

2. Description of the Related Art

Rifles, shotguns, and other long guns tend to be large and relatively heavy. Shooters such as hunters often carry their guns for long distances and for a long period of time, hiking to and from remote hunting grounds or simply waiting for game to appear. A gun sling that allows the gun to be carried on the hunter's shoulder eases the burden of carrying the gun, and frees the hunter's hands for other tasks.

It is desirable for a gun sling to be adjustable for use by hunters of different sizes, as well as for use in different positions. Also, many hunters are likely to appreciate a gun sling that has an aesthetic quality that is respectful of the outdoors and wilderness, using natural materials and exhibiting fine craftsmanship.

Many different kinds of slings, as well as other gun carrying devices, are known. Many shooters prefer a simple shoulder sling, while others desire more complicated slings that provide support while shooting, allow the gun to be lashed to a backpack, allow the gun to be supported by both shoulders, or provide some feature above and beyond the simple shoulder gun sling.

U.S. Pat. No. 4,817,835, issued on Apr. 4, 1989 to E. Tarr, Jr. discloses a versatile gun sling that can be used as a conventional gun sling, carrying the gun over a single shoulder. Additionally, the sling can be used to carry the gun on both shoulders, "back pack style." The sling is formed from a long strip of material, with a slit running parallel to the length of the strap to form two strips, joined at each end. The sling can be worn with both strips over a single shoulder, or the strips separated over both shoulders to distribute the weight. While some users would find this arrangement advantageous, others will prefer a simple single shoulder sling. Additionally, while the sling is adjustable, it requires manipulation of a clasp and a clasp keeper before a length adjustment can be made.

Numerous single-shoulder gun slings are known. These typically are a long strip of a material, such as a fabric, leather, or other material. To make the sling adjustable, a loop is formed in one end that has one or more slideable hardware fittings that allow the loop to be varied in size, thus adjusting the overall length of the sling.

U.S. Pat. No. 5,433,360, issued on Jul. 18, 1995 to T. Rock, illustrates a weapon sling that uses slides, buckles, and other fittings for adjustment of the belt.

U.S. Pat. No. 5,802,756, issued on Sep. 8, 1998 to F. Hightower, discloses an adjustable gun sling. Rather than a simple sling, the Hightower sling includes a shoulder pad, a thumb-loop for over the shoulder carrying, and fittings for attachment and adjustment of the sling.

U.S. Patent Application Publication US 2003/0041498 A1 of S. Mazzagetti, published on Mar. 6, 2003, discloses a gun sling that uses a slideable tension lock fitting to adjust the length.

None of the above inventions and patents, taken either singly or in combination, is seen to describe the instant invention as claimed. Thus a adjustable leather rifle sling solving the aforementioned problems is desired.

SUMMARY OF THE INVENTION

The adjustable leather rifle sling is a single-shoulder gun sling, formed from a single strip of leather. The adjustable leather rifle sling is made adjustable without the need for clasps, slides, buckles or other fittings. Instead, features of hand-crafted leather provide for length adjustment of the sling.

The adjustable leather rifle sling is formed from a single leather strap. A large adjustable loop is formed in one end of the leather strap, and secured by a slide-lock knot. The slide-lock knot is formed by cutting two slits into the leather strap, to form three small strips. Each of the small strips is turned 90° so that three small bands are formed perpendicular to the length of the leather sling. The adjustable loop is made by passing an end of the leather strap through the bands of the slide-lock knot. Thus, an adjustable loop is formed in the adjustable leather rifle sling without the need for clasps, slides, buckles or other fittings.

Accordingly, it is a principal object of the invention to provide an adjustable leather rifle sling that can be adjusted without clasps, slides, buckles or other fittings.

It is another object of the invention to provide an adjustable leather rifle sling that is simply made with a minimum of hardware fittings such as clasps, slides, and buckles.

It is a further object of the invention to provide an adjustable leather rifle sling that is more aesthetically pleasing in appearance.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
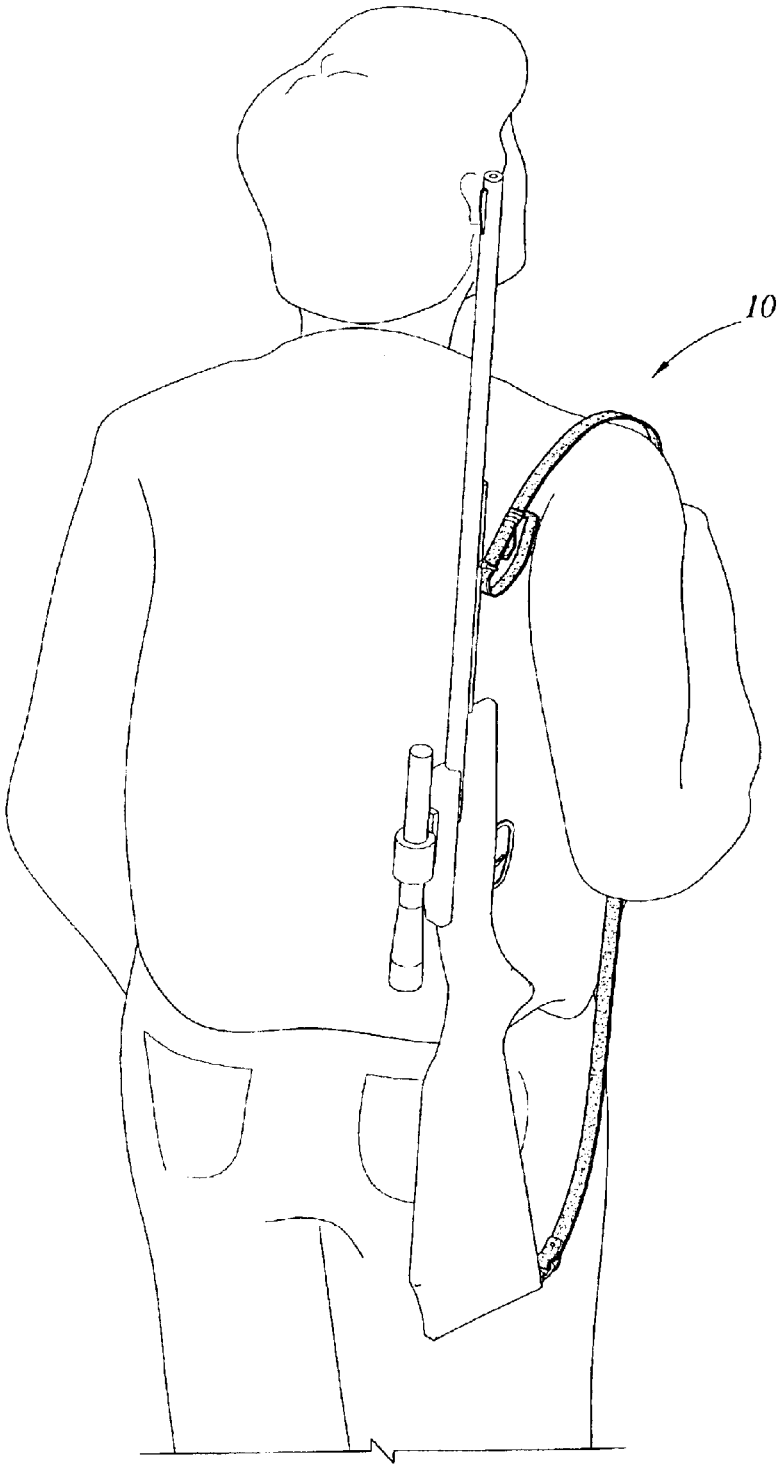
FIG. 1 is an environmental, perspective view of an adjustable leather rifle sling according to the present invention.

The present invention is an adjustable leather rifle sling, designated generally as 10 in the drawings. As shown in FIG. 1, the adjustable leather rifle sling 10 is a sling for carrying a rifle, or other long gun, in a shoulder-carried manner.

Figure 2:
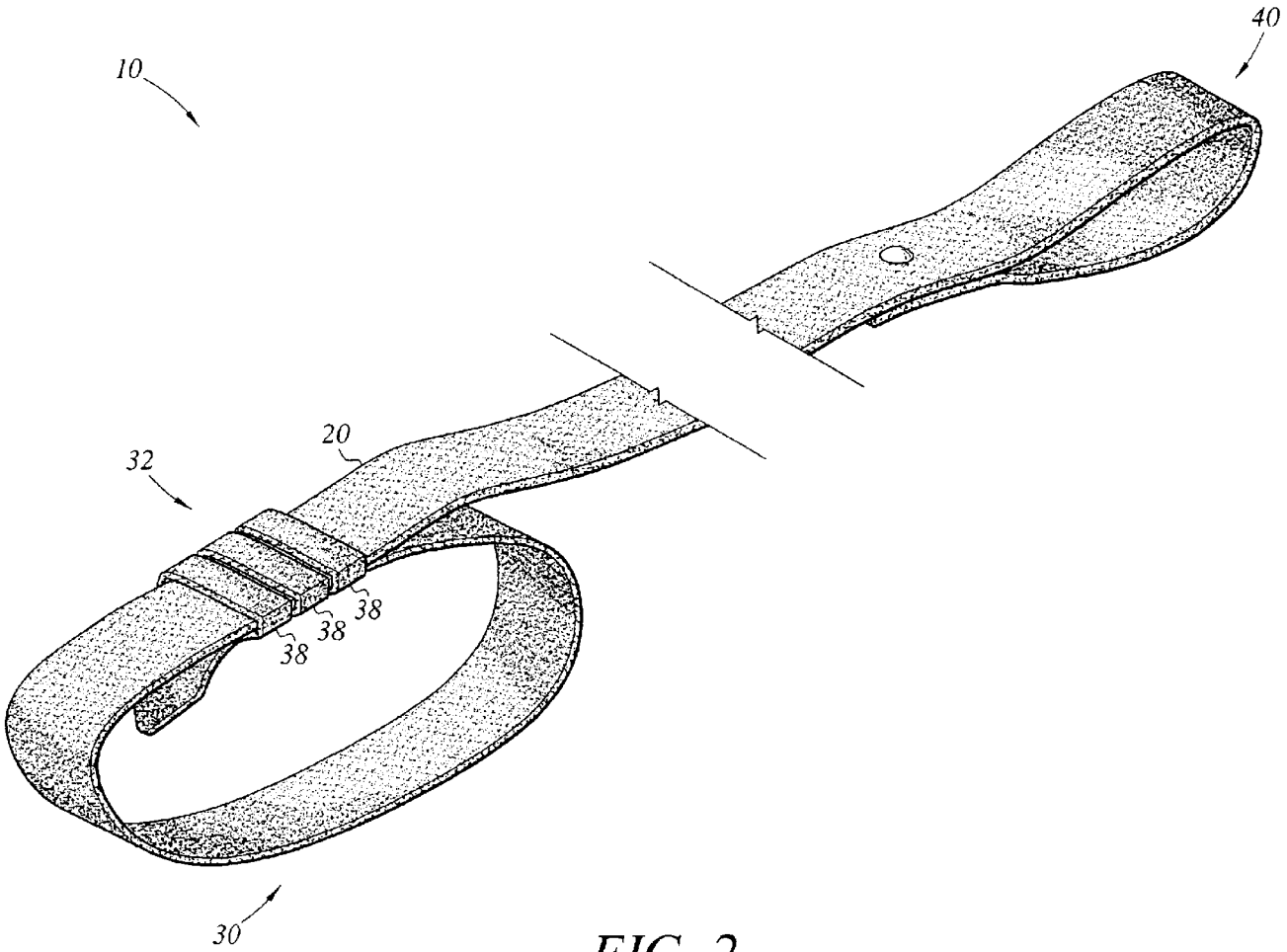
FIG. 2 is a perspective view of an adjustable leather rifle sling according to the present invention.

Turning to FIG. 2, the adjustable leather rifle sling 10 is formed from a leather strap 20, although other materials can be used. A large, adjustable loop 30 is formed at one end of the strap. A slide-lock knot 32, comprised of bands of material formed in the leather strap 20, secures the large, adjustable loop 30. In use, the large, adjustable loop 30 is attached to the forward, stock end of the gun. A small, fixed loop 40 is formed at the other end of the leather strap 20.

Figure 3:
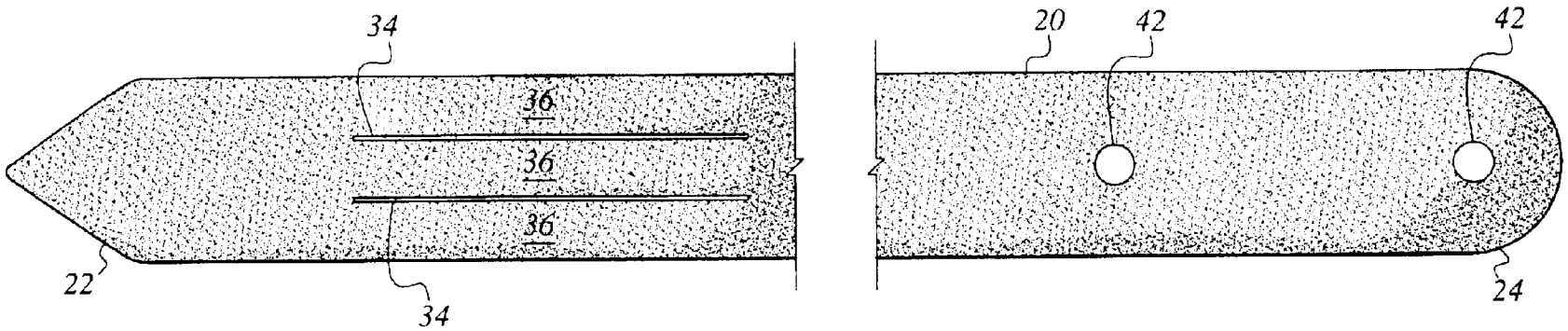
FIG. 3 is a plan view of a leather strap used to make an adjustable leather rifle sling according to the present invention, showing slits cut near an end of the strap to form the strips of material that will be formed into a slide-lock knot.
Figure 4A:
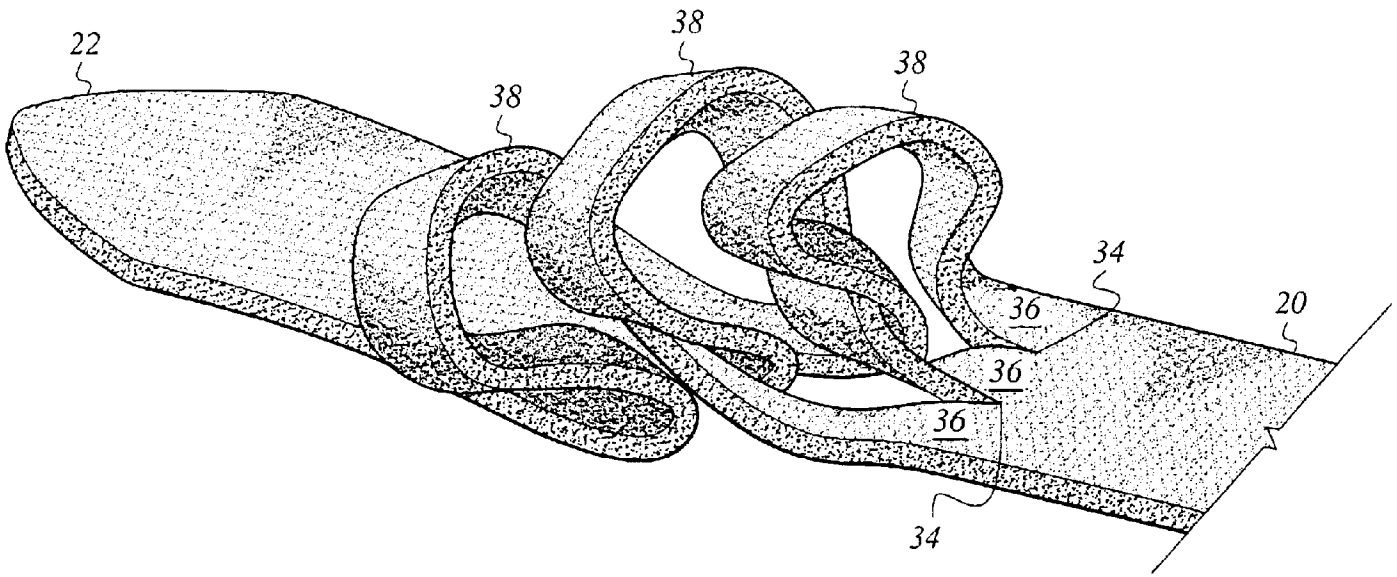
FIG. 4A is a perspective view of an end of the leather strap, showing strips of material turned to form bands that make the slide-lock knot.

FIG. 3 shows the leather strap 20 before assembly into the adjustable leather rifle sling 10. The leather strap 20 has a stock end 22 and a butt end 24. Near the butt end 24 a pair of apertures 42 are formed through the leather strap 20 for receiving a fastener. Slits 34 are cut into the leather strap 20 near the stock end. Cutting the slits 34 forms strips 36. Illustrated in FIG. 4A, the strips 36 are twisted to form bands 38 of the slide-lock knot 32. A slide-lock knot 32 with three bands 38 is preferred, so two slits are cut to form three strips.

Figure 4B:
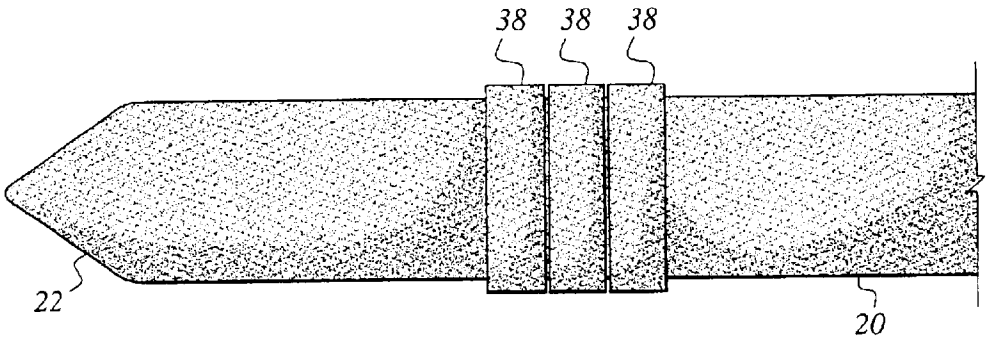
FIG. 4B is a top view of the leather strap with bands formed.
Figure 4C:
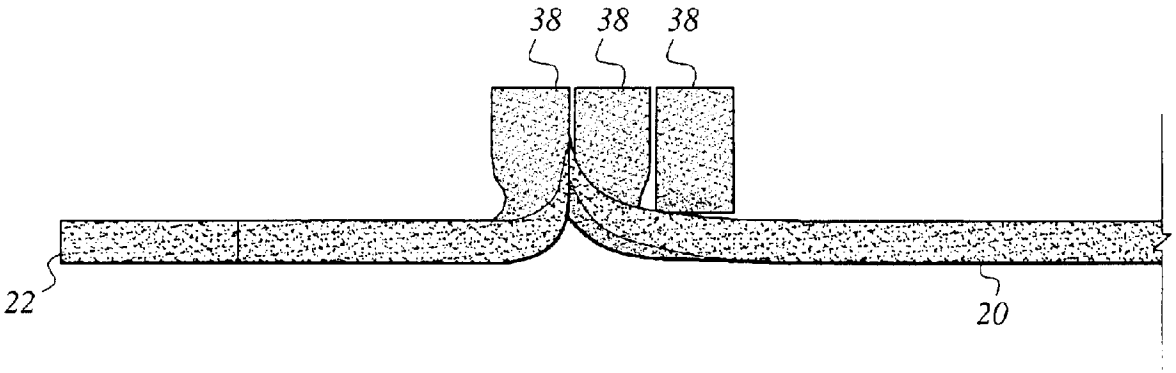
FIG. 4C is a side view of the leather strap with bands formed.

As seen in FIGS. 4B and 4C, the bands 38 are perpendicular to the length of the leather strap 20.

Figure 4D:
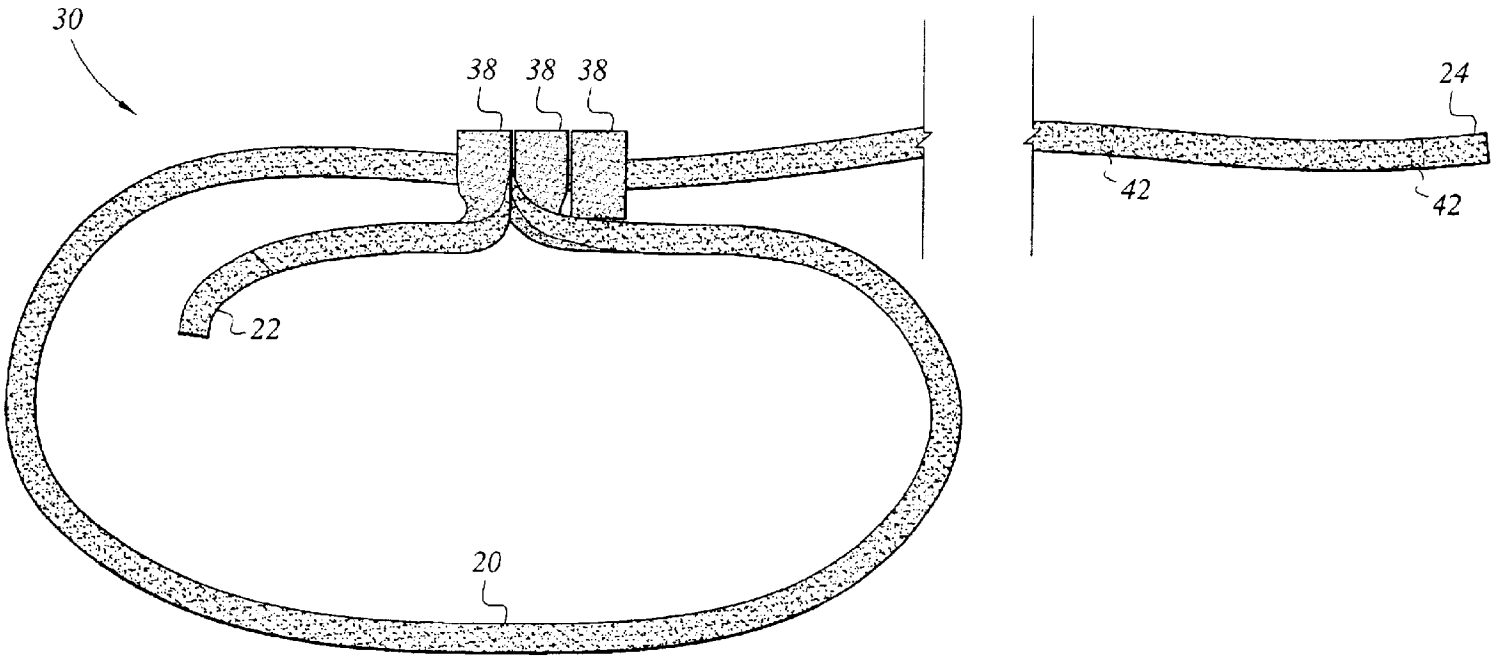
FIG. 4D is a side view of the leather strap with bands formed, with the second end of the strap passed through to form an adjustable loop.

The large, adjustable loop 30 is shown in FIG. 4D, formed by passing the butt end 24 of the leather strap 20 through the bands 38 of the slide-lock knot 32.

Figure 5A:
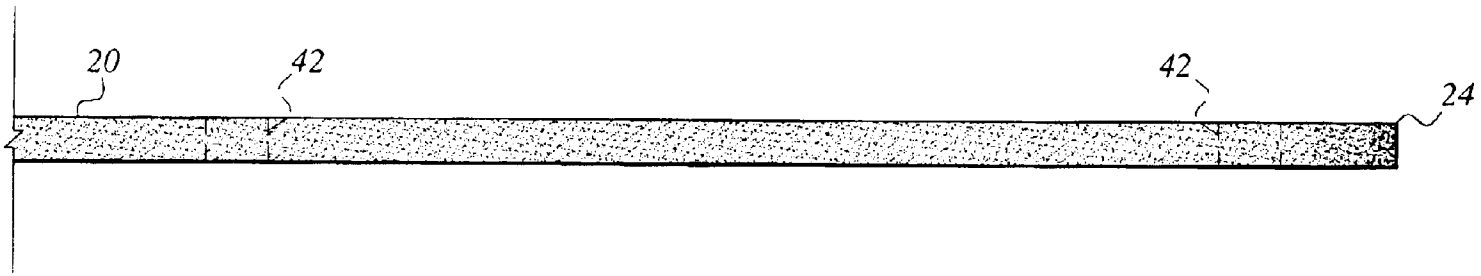
FIG. 5A is a side view of the butt end of the leather strap.
Figure 5B:
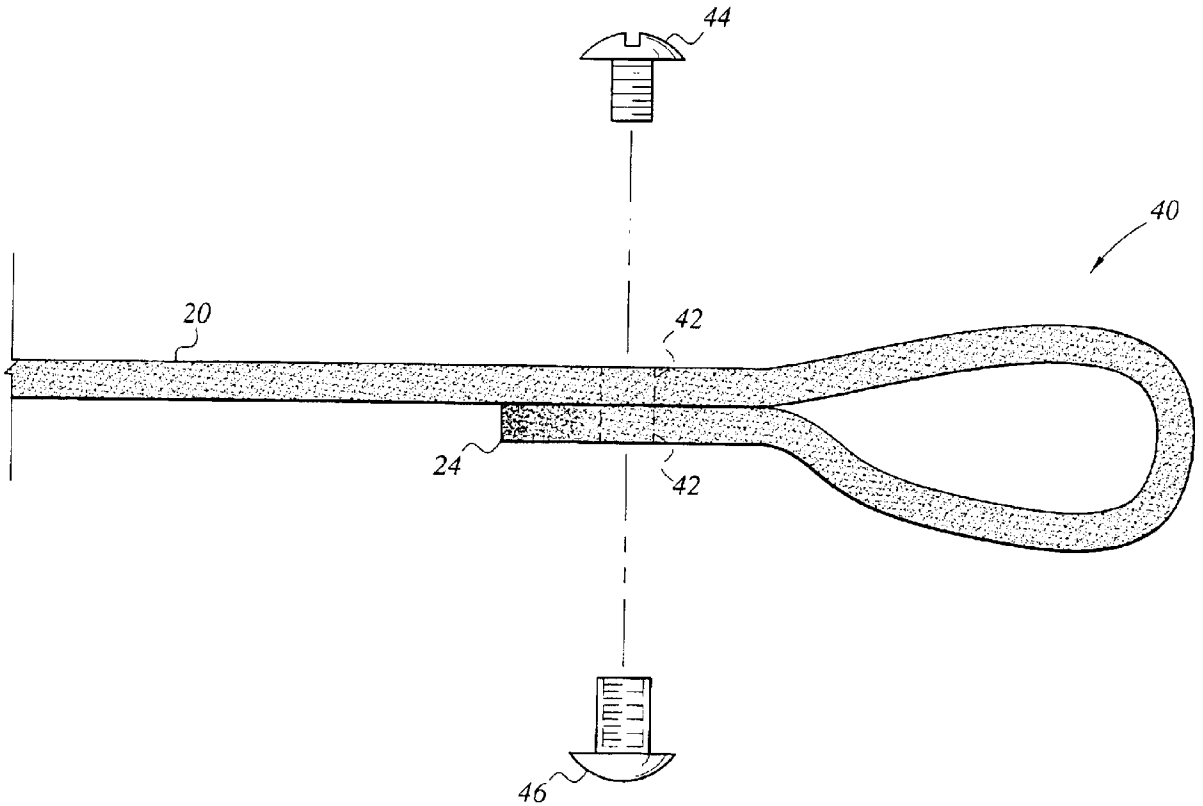
FIG. 5B is a side view of the butt end of the leather strap formed into a small loop for attachment to the gun.

FIGS. 5A and 5B show the formation of the small loop 40 in the butt end 24 of the leather strap 20. Apertures 42 are formed through the leather strap 20 near the butt end 24. The butt end 24 is folded back over the leather strap 20, bringing the apertures 42 into alignment. A fastener is disposed through the apertures to secure the small loop 40. A Chicago screw, having a screw post 46 that receives a screw 44, is a preferred fastener because it can be repeatedly unfastened and refastened as necessary to attach the small loop 40 to a rifle's sling fitting.

It is to be understood that the present invention is not limited to the embodiment described above, but encompasses any and all embodiments within the scope of the following claims.

I claim:

1. An adjustable rifle sling, comprising:

a strap having first and second ends and a longitudinal axis;

a plurality of bands formed in said strap, the bands being near said first end, the bands being generally perpendicular to said longitudinal axis of said strap;

said second end of said strap being passed through said bands forming a large loop in said strap;

wherein said large loop is adjustable by sliding said bands along the length of said strap.

2. The adjustable leather rifle sling according to claim 1, further comprising:

first and second apertures formed through said strap, the first and second apertures being formed near said second end along said longitudinal axis; and a fastener;

wherein said second end is folded back over said strap bringing said first and second apertures in alignment and forming a small loop, said fastener being disposed through said first and second apertures, said fastener securing said small loop.

3. The adjustable leather rifle sling according to claim 1, wherein said plurality of bands comprises three bands.

4. The adjustable rifle sling according to claim 1, wherein said strap is a leather strap.

5. The adjustable leather rifle sling according to claim 1, wherein said fastener is a Chicago screw.

* * * * *